US010458133B2

(12) United States Patent
Davis

(10) Patent No.: US 10,458,133 B2
(45) Date of Patent: Oct. 29, 2019

(54) PERIMETER WARNING SYSTEM

(71) Applicant: Daniel L. Davis, Ringwood, IL (US)

(72) Inventor: Daniel L. Davis, Ringwood, IL (US)

(73) Assignee: D & T Industrial Supplies, Inc., Schaumburg, IL (US)

( * ) Notice: Subject to any disclaimer, the term of this patent is extended or adjusted under 35 U.S.C. 154(b) by 0 days.

(21) Appl. No.: 15/648,862

(22) Filed: Jul. 13, 2017

(65) Prior Publication Data

US 2018/0016801 A1 Jan. 18, 2018

Related U.S. Application Data

(60) Provisional application No. 62/362,182, filed on Jul. 14, 2016.

(51) Int. Cl.
*E04G 21/32* (2006.01)
*E01F 13/02* (2006.01)
(Continued)

(52) U.S. Cl.
CPC ..... *E04G 21/3233* (2013.01); *E01F 13/028* (2013.01); *E04H 17/00* (2013.01); *G09F 17/00* (2013.01); *G09F 2017/0083* (2013.01)

(58) Field of Classification Search
CPC .... E04G 21/3233; E01F 13/028; E04H 17/00; G09F 17/00; G09F 2017/0083
(Continued)

(56) References Cited

U.S. PATENT DOCUMENTS 2,192,635 A 3/1940 Bricker
2,782,745 A 2/1957 Paschke
(Continued)

FOREIGN PATENT DOCUMENTS

FR 2776385 A1 9/1999
FR 2776385 B1 5/2000
(Continued)

OTHER PUBLICATIONS

Garlock Safety Systems—Sentinel (dated Oct. 20, 2014 by "Internet Archive Wayback Machine" website—http://www.archive.org) (Year: 2014).*

(Continued)

*Primary Examiner* — Justin Seo
*Assistant Examiner* — Tania C Courson
(74) *Attorney, Agent, or Firm* — Advitam IP, LLC

(57) ABSTRACT

A perimeter warning system is provided having a plurality of substantive stand bases and stanchions, which when combined together with a flag line provide a means to demark the perimeter of a surface across which there is danger. The stand bases include a surface onto which an insertion sleeve is placed, for holding the stanchion stably, and an opening symmetrically equidistant from the center of the surface of the stand base from the sleeve. In this way, stand bases can be stacked together with the sleeve of one placed in the opening in the surface of the other for stability. The system includes storage and transportation elements; wherein the surface of the base stand defines an opening through which the pillar of a storage unit can be threaded to stack the plurality of base stands together onto the storage element. Stanchions are provided with storage boxes configured to stack together neatly and stably.

15 Claims, 8 Drawing Sheets

(51) Int. Cl.
*E04H 17/00* (2006.01)
*G09F 17/00* (2006.01)

(58) Field of Classification Search
USPC .... 116/28 R, 309, 311, 312, 315, 319, 63 C, 116/63 P, 63 R, 173; 40/590–593, 40/606.14, 606.15, 612, 611.01, 611.02; 404/6, 9, 10
See application file for complete search history.

(56) References Cited

U.S. PATENT DOCUMENTS 3,586,277 A * 6/1971 Voris, Jr. ..... A47G 19/23 248/146
3,705,566 A * 12/1972 Duckett ..... E01F 9/688 116/63 C
3,883,037 A 5/1975 Seiller
4,219,141 A * 8/1980 Lovy ..... E01F 9/70 116/28 R
4,311,237 A * 1/1982 Hayes ..... A47G 23/08 206/203
4,889,067 A * 12/1989 Provence, Jr. ..... E01F 9/688 116/63 C
5,036,791 A * 8/1991 Thurston ..... E01F 9/692 116/63 C
5,094,422 A 3/1992 Tiffany
5,525,021 A * 6/1996 Larguier ..... E01F 9/70 414/551
5,993,105 A * 11/1999 Chan ..... E01F 9/629 116/173
6,186,699 B1 * 2/2001 Kulp ..... E01F 9/688 116/63 C
6,435,369 B1 * 8/2002 Poursayadi ..... E01F 9/70 221/185
6,752,582 B2 * 6/2004 Garcia ..... E01F 9/688 116/63 C
6,935,059 B1 * 8/2005 Chang ..... G09F 7/18 256/1
7,243,450 B2 * 7/2007 Dicke ..... G09F 15/0056 248/167
7,338,033 B2 * 3/2008 Anson ..... E01F 13/022 256/59
7,344,051 B2 * 3/2008 Flamingo ..... E01F 9/688 221/213
7,654,501 B2 2/2010 Matthews
8,500,360 B1 * 8/2013 Jones ..... E01F 9/70 256/13.1
8,505,772 B2 * 8/2013 Martin ..... A47F 1/10 206/155
8,573,609 B1 * 11/2013 Moser ..... B62B 1/14 135/118
D705,110 S * 5/2014 Wray ..... D10/121
8,777,512 B2 * 7/2014 Henderson ..... E01F 13/02 116/63 C
8,820,522 B2 * 9/2014 Quarry ..... A45C 5/04 206/315.1
9,200,467 B2 12/2015 Williams
9,347,189 B2 * 5/2016 Eccless ..... E01F 9/688
9,863,578 B2 * 1/2018 Cuttill ..... E01F 9/688
10,053,344 B1 * 8/2018 Angel ..... B66F 7/243
2004/0065794 A1 * 4/2004 Higgs ..... E04G 21/3233 248/188.8
2005/0220537 A1 * 10/2005 Bentley ..... B65H 75/38 404/9
2007/0183874 A1 * 8/2007 Garcia ..... E01F 9/688 414/437
2007/0241255 A1 10/2007 Dvoracek
2009/0097914 A1 * 4/2009 Flynn ..... E01F 9/70 404/9
2011/0220010 A1 * 9/2011 Klein ..... E01F 13/028 116/63 C
2012/0076970 A1 * 3/2012 Suter ..... E01F 13/028 428/80

FOREIGN PATENT DOCUMENTS

WO 2007141398 A1 12/2007
WO 2007141398 A9 3/2009

OTHER PUBLICATIONS

Garlock Safety Systems, Visual Warning Lines, Everlast TM-Folding—Sentinel TM, Copyright 2018, p. 2, Plymouth MN, US.

* cited by examiner

PERIMETER WARNING SYSTEM

FIELD OF THE INVENTION

The present invention concerns an improved perimeter warning system. More particularly, the present invention concerns a perimeter warning system comprising flag lines, stanchions and stands and a means and method of storing, transporting and deploying the system to provide a perimeter warning.

BACKGROUND OF THE INVENTION

Perimeter warning systems are allowed by law in many jurisdictions, including throughout the United States, as a substitute for harnesses and other protective equipment, to provide workers with a warning that they are approaching the edge of a safe zone, such as an open floor of a building under construction. Such warning lines can be substituted for fall-prevention equipment under certain circumstances. They are considered, as well, a genuine aid to persons at risk, even in locations where such safety protection is not mandated.

According to the Occupational Safety and Health Administration (OSHA) of the United States, along with mandated safety requirements for workers at height, additional fall protection systems can be used. Among these are warning lines systems, pursuant to 29 CFR 1926.502(f).

OSHA defines a warning line system as a barrier erected on a roof to warn workers that they are approaching an unprotected roof side or edge, and to designate an area in which roofing work may take place without the use of guardrails, body harnesses, or safety net systems to protect workers in the area. Warning line systems consist of ropes, wires, or chains, plus supporting stanchions. If an employer chooses to use warning line systems, the following provisions apply:

- The warning line must be erected around all sides of roof work areas. 29 CFR 1926.502(f)(1).
- When mechanical equipment is not being used, the warning line must be erected at least 6 feet from the roof edge. 29 CFR 1926.502(f)(1)(i).
- When mechanical equipment is being used the warning line must be erected:
  - At least 6 feet from the roof edge parallel to the direction of mechanical equipment operation; and
  - At least 10 feet from the roof edge perpendicular to the direction of mechanical equipment operation. 29 CFR 1926.502(f)(1)(ii).
- The rope, wire, or chain must be flagged at not more than 6-foot intervals with high-visibility material. 29 CFR 1926.502(f)(2)(i).
- The rope, wire, or chain must be rigged and supported so that:
  - The lowest point (including sag) is at least 34 inches from the walking or working surface; and
  - Its highest point is no more than 39 inches from the walking or working surface. 29 CFR 1926.502(f)(2)(ii).
- Stanchions, after being rigged with warning lines, must be capable of resisting, without tipping over, a force of at least 16 pounds applied horizontally against the stanchion, 30 inches above the walking or working surface, perpendicular to the warning line and in the direction of the floor, roof, or platform edge. 29 CFR 1926.502(f)(2)(iii).

- The rope, wire, or chain must have a minimum tensile strength of 500 pounds. After being attached to the stanchions, it must support, without breaking, the loads applied to the stanchions as prescribed in 29 CFR 1926.502(f)(2)(iii) & 29 CFR 1926.502(f)(2)(iv).
- The rope, wire, or chain must be attached to each stanchion in such a way that pulling on one section of the line between stanchions will not result in slack being taken up in the adjacent section before the stanchion tips over. 29 CFR 1926.502(f)(2)(v).

These regulations are well known and followed throughout the United States, as well as in other countries where US guidelines are adopted as helpful. There are any number of perimeter warning systems available in the marketplace. However, problems subsist in that existing warning schemes that comprise perimeter lines require, by regulation, additional elements to keep the lines in place and provide a substantial visual indication as to where the perimeter is. While most of these systems comprise a length of cord or string, wire cable to mark the perimeter and many of those include pennants or flags at regular intervals to allow the perimeter to be seen at a distance or in conditions where visibility is affected, all of such systems are subject to exterior elements such as wind, weather and other conditions that can inflict damage to such components as the flags and ropes/wires/cables used. As noted above, the regulations allow work to continue while the warning system is in place and would require that work stop if any of the above noted regulations was not extant and not start again until equipment, to the letter of the regulations, is restored. It will be seen that such warning systems are an accommodation to work and construction zones, but if not properly done and maintained, would force work to stop until properly done or replaced by more stringent harness and protective equipment standards.

Additionally, problems in the prior usage of warning lines include: where the flags and lines are attached to poles, columns or other upright members, places to mount the upright members in a structure under construction (where a perimeter warning is needed) can be problematic and require continued maintenance. Where apparatus to mount the flag lines has been created, problems exist with storing and moving such devices as construction progresses or to new locations or moving them into storage for future use. Existing devices have been found to be difficult to use, maintain in place, store, transport and reuse, due to such things as the large variety of roofs and roof types, building floors, sizes and areas and roofing materials; bulky items used to string perimeter lines are often required to provide the weight and mass to anchor the warning line as required by law; movement of a warning line system from storage to situs of use and/or their return to storage is difficult, due generally to the weight and bulkiness of the warning systems in general and the effort needed to neatly collect and store such systems. Where such systems lack bulk they typically have been found to fail in adverse condition, increasing the danger to workers or the stoppage of work until the perimeter lines can be restored.

It would be desirable to have a perimeter warning system that is easy to be seen and therefore provide a safe work environment as well as be easy to store and deploy, be capable of sustaining itself on a roof or open floor situation regardless of wind and weather situations and can be easily collected and stored and then transported quickly and efficiently as needed, while maintaining the integrity of the components for use and reuse.

It is therefore an object of the present invention to provide a means for having a safe, effective, storable and transportable warning system for workers working at height and at other perimeter situations. Other objects and advantages of the present invention will become apparent as the description proceeds.

SUMMARY OF THE INVENTION

In accordance with the present invention, a perimeter warning system for use to warn persons of the proximity of an edge of a surface on which they are present, is provided. The warning system comprises, at least a flag line, a plurality of stanchions or poles, and a plurality of base stands, at least equal in number to the plurality of stanchions. Each base stand of the system has means to hold at least one stanchion in a generally upright position on the base stand when assembled together; and each base stand also has means to be secured to a storage element when not in use.

Each base stand of the invention is capable of placement near the edge of a surface across which edge there is danger. In this manner, when the plurality of base stands and plurality of stanchions are assembled together to form a means to hold the flag line, there is created a visible line of flags to warn of the proximity of the edge of the surface.

In addition, the perimeter warning system includes a means for which the plurality of base stands is capable of being placed together on a storage element, for ease of storage and transportation.

In this system, the means to hold at least one stanchion on a base stand is a stanchion insertion point. The stanchion insertion point in a preferred embodiment comprises a sleeve into which the stanchion is berthed. In addition, each of the base stands has a top surface which defines an opening into which the stanchion insertion point of another of the base stands can be inserted, when the base stand and the another base stand are stacked together. The stanchion insertion point of each base stand and the opening defined in the surface of each base stand in the preferred embodiment, is symmetrically equidistant from the center point of the surface of that base stand.

The surface of the base stand defines at least one other opening that allows for any water thereon to drain off of the surface of the base stand.

The storage element of the perimeter warning system comprises a storage and transportation base, the storage and transportation base comprising a surface onto which the plurality of base stands can be stacked, one atop another, for storage and transportation. In a preferred embodiment, the storage and transportation base comprises at least one pillar extending, generally perpendicularly, from the surface of the storage and transportation base. Additionally, the opening defined in the surface of each of the plurality of base stands is defined so as to allow the at least one pillar to be threaded therethrough.

The perimeter warning system can including at least one storage case for holding the plurality of stanchions for storage and transportation when the warning system is not in use. When there is more than one case, due to the large numbers of stanchions, the two storage cases having means to allow them to be stacked together.

A more detailed explanation of the invention is provided in the following description and claims and is illustrated in the accompanying drawings.

DETAILED DESCRIPTION OF THE ILLUSTRATIVE EMBODIMENT

Figure 1:
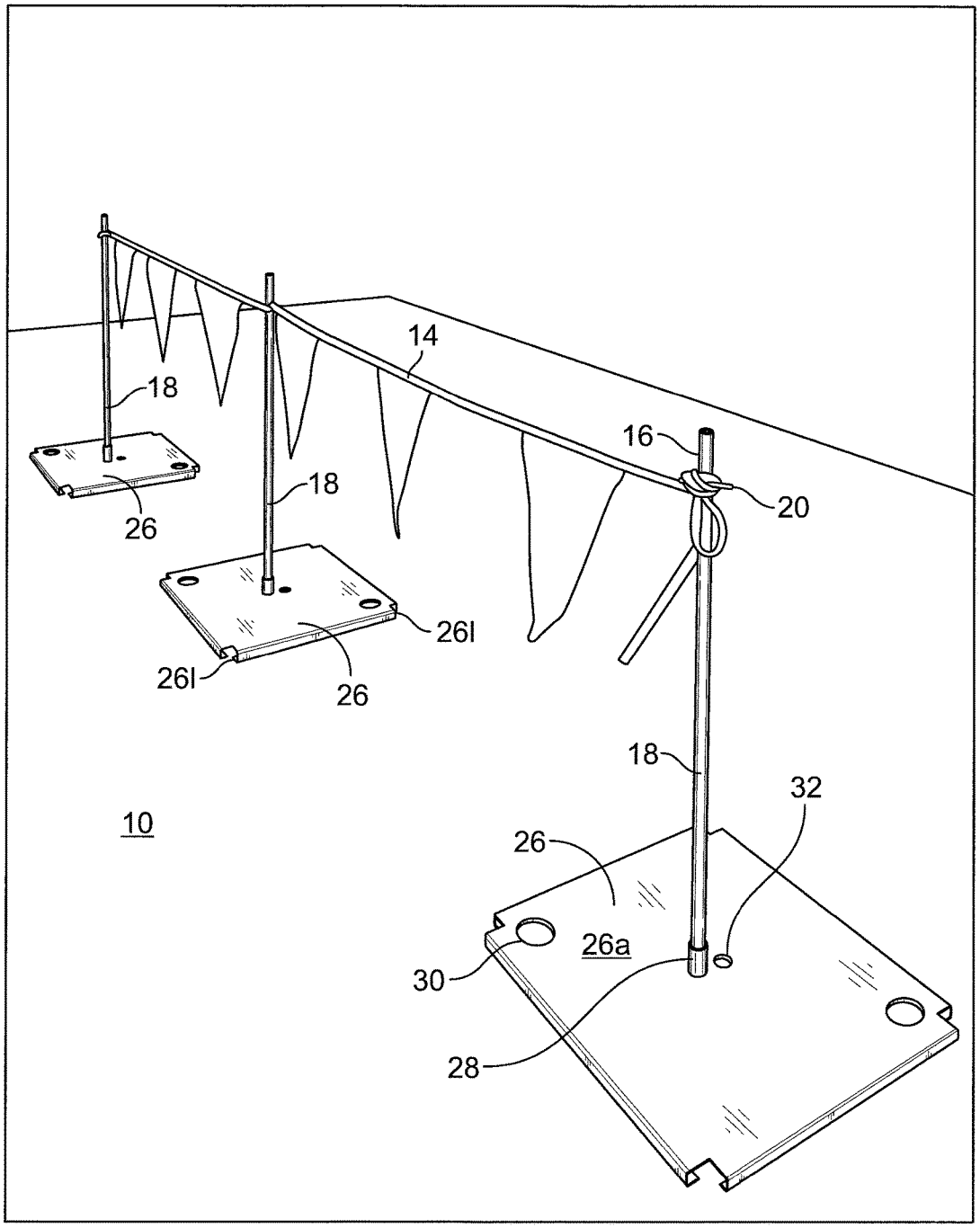
FIG. 1 is a perspective view of a warning line system of the present invention.

While the present invention is susceptible of embodiments in various forms, there is shown in the drawings and will hereinafter be described some exemplary and non-limiting embodiments, with the understanding that the present disclosure is to be considered an exemplification for the invention and is not intended to limit the invention to the specific embodiments illustrated. In this disclosure, the use of the disjunctive is intended to include the conjunctive. The use of the definite article or indefinite article is not intended to indicate cardinality. In particular, a reference to "the" object or "a" object is intended to denote also one of a possible plurality of such objects. It should be further understood that the title of this section of the application ("Detailed Description of the Illustrative Embodiment") relates to a requirement of the United States Patent and Trademark Office, and should not be found to limit the subject matter disclosed herein.

Referring now to the drawings, FIG. 1 shows an embodiment of the perimeter warning system 10 of the present invention; specifically presented as a segment of a warning line system comprising flags, shown in the manner in which it would be deployed along the perimeter of a work situation. FIG. 1 shows that system 10 provides multiple generally vertical positioned stanchions or poles 18 and a flag line 14 connecting the multiple stanchions 18 to provide a perimeter line. As illustrated, stanchion 18 comprises a length of durable tubing, such a steel pipe or pipe of other structurally significant material. It will be understood that stanchion 18 can be made of any number of materials and in any number of cross sectional shapes and act in accordance with the teaching of the present invention. While flag line 14 is depicted as a length of flat reinforced nylon line with pennant flags extending therefrom, it is to be understood that any manner of creating the perimeter defining member, such as with rope, cable, chain, wire or others (as noted in the regulations identified above) and with any shaped flag or pennant or other means of defining a line and providing a means for the line to be seen clearly at a distance, can be used in the present invention, without departing from the novel scope thereof and complying with regulations of law.

Figure 4:
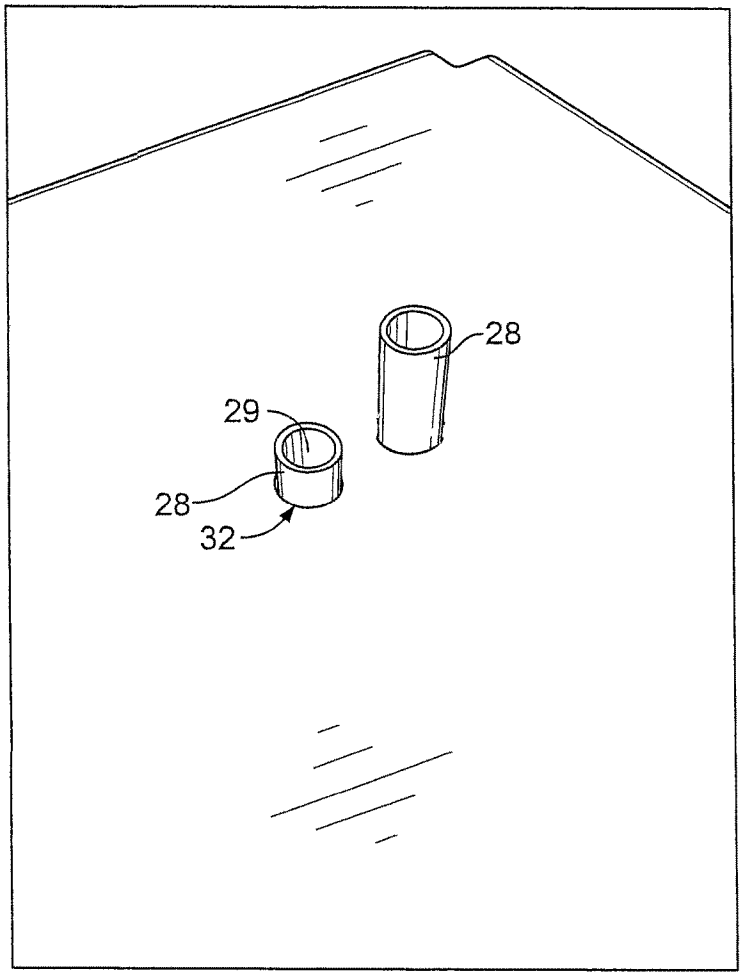
FIG. 4 is a perspective view of a stand of the present invention.

As shown in FIG. 1, a stand base 26, comprising a platform having openings and or holding means, as will be described in greater detail below, is provided into which stanchion 18 can be fitted. In the illustrative embodiment, a stanchion insert 28 is provided on the surface 26*a* of stand base 26, such that a stanchion 18 can be placed therein and held in position. Stanchion insert 28, as illustrated, is configured so as to support a stanchion in a generally upright stable position when inserted into insert 28 and allow, as will also be described below, for stand base 26 to be nested together with other stand bases 26. Stanchion insert 28 can be seen, in the figures, as a segment of pipe, or other tubing, having an inner diameter slightly larger than the diameter of stanchion 18, such that stanchion 18 can slide into insert 28 for support while maintaining a low rise stand 26 height. In this way, stanchion 18 is properly supported in stand 18, while keeping the height of stand 26 low to provide a safer environment for walking nearby the warning line, and as will be explained later, a lower profile allowing for stacking more stands 26 together for ease of storage and transportation. It will be understood, that insert 28 can be made of any shape and size to accommodate a corresponding stanchion 18 of similar shape and size. In addition, as will be described, stand 26 can be made so that it provides an opening through stand 26 to allow liquids, such as rain water, to pass through; insert 28 can likewise be made to have a solid bottom as a sealed tube, or can be made so that it is has an opening at its bottom, to provide for the drainage of, for example, rain water away from stanchions 18, as desired and all without departing from the novel scope of the present invention. In a preferred embodiment, as shown in FIG. 4, insert 28 provides a pass through opening 29 for drainage purposes and to provide access for removal of a stanchion 18 wedged in place.

It will be seen that in the illustrative embodiment, stanchion insert 28 is offset from the center of stand base 26 generally an equal distance from the location of a surface opening 32 in stand base 26. In this manner, and as described in more detail below, two or more stand bases 26 can be stacked together by rotating the one stand base 26 180° relative to the other such that stanchion insert 28 fits into, from below, surface opening 32 of another stand base 26. As will be made clear as the description continues, the length of stanchion insert 28 can be made such that when it is in place in the surface opening 32 of a second stand base 26, it extends slightly above the surface of the second stand base 26, when they are mounted together as described above. In this manner, any number of stand bases 26 can be stacked together without their respective stanchion inserts 28 interfering with each other (see FIG. 4). As will be discussed in more detail below, the stability of a number of stand bases 26 will be increased by this interaction of the stanchion insert 28 of one stand base 26 with the surface opening 32 of another stand base 26.

Figure 3:
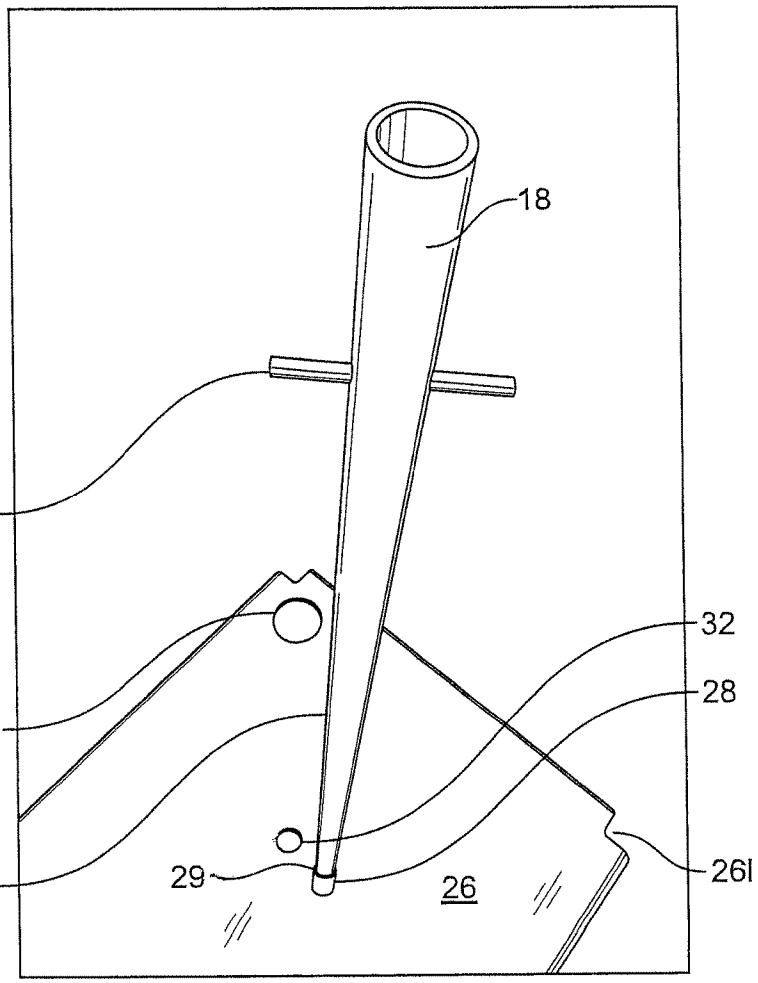
FIG. 3 is a closer perspective view of a stanchion of the present invention.

As will be seen most particularly in FIG. 3, stanchion 18 can include an additional element, or extension piece, 20 attached to stanchion 18. It will be understood by persons having ordinary skill in the art, that extension piece 20 can be made or added to stanchion 18 in a variety of manners known to persons having ordinary skill in the art, including being molded or cast thereon, welded thereto or connected, such as by the use of bolts threaded into stanchion 18, or created in any number of ways. Extension pieces 20 serves to add functionality to stanchion 20 as will be described in detail below. One or more extension pieces 20 can be disposed on stanchion 18 near the end of the stanchion opposite the end that is inserted into a stand base 26; extension pieces 20 typically serve as anchoring points, such as for flag lines, and having other purposes as will be known to persons having ordinary skill in the art.

Figure 2:
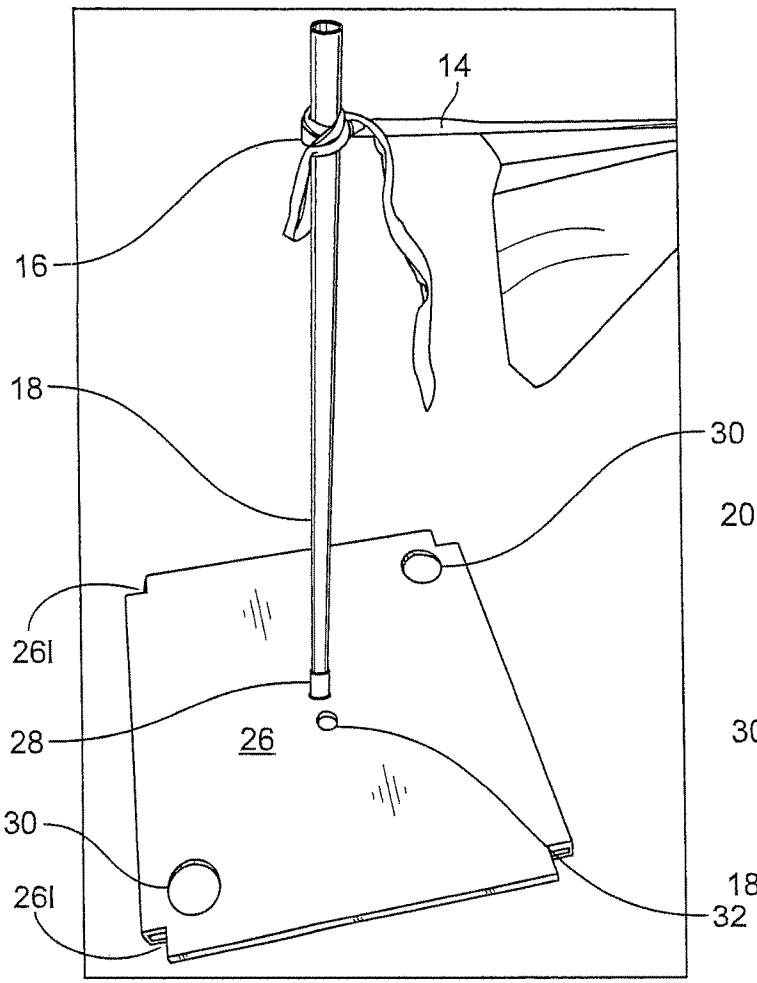
FIG. 2 is a perspective view of one stanchion and stand of the present invention.

Continuing with the discussion of the figures, and as shown in FIGS. 1, 2 and 3, in at least one embodiment of the present invention, one element of a perimeter warning system flag stand configuration comprises a stanchion 18 and a stand base 26. In one form, stand base 26 may comprise a stanchion insert point 28 having one or more liquid/water drain holes 29, pillar receiving openings 30 (as described in greater detail below), positioned in a preferred embodiment, near opposite corners of stand base 26, as shown in FIG. 2. It will be seen that openings defined in stand base 26 provide both a necessary element to the function of the present invention and provide a means to save weight and material in the creation of the devices of the present invention.

Figure 5:
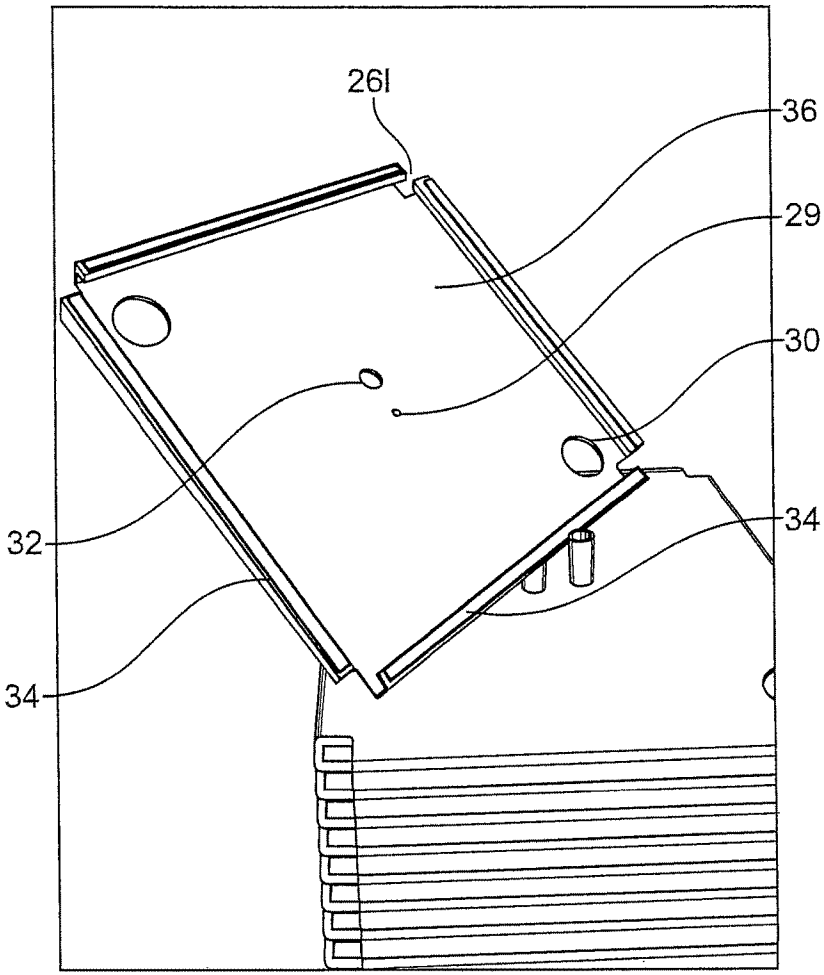
FIG. 5 is a perspective view of a stack of stands of the present invention, shown in transportation and storage configuration.
Figure 6:
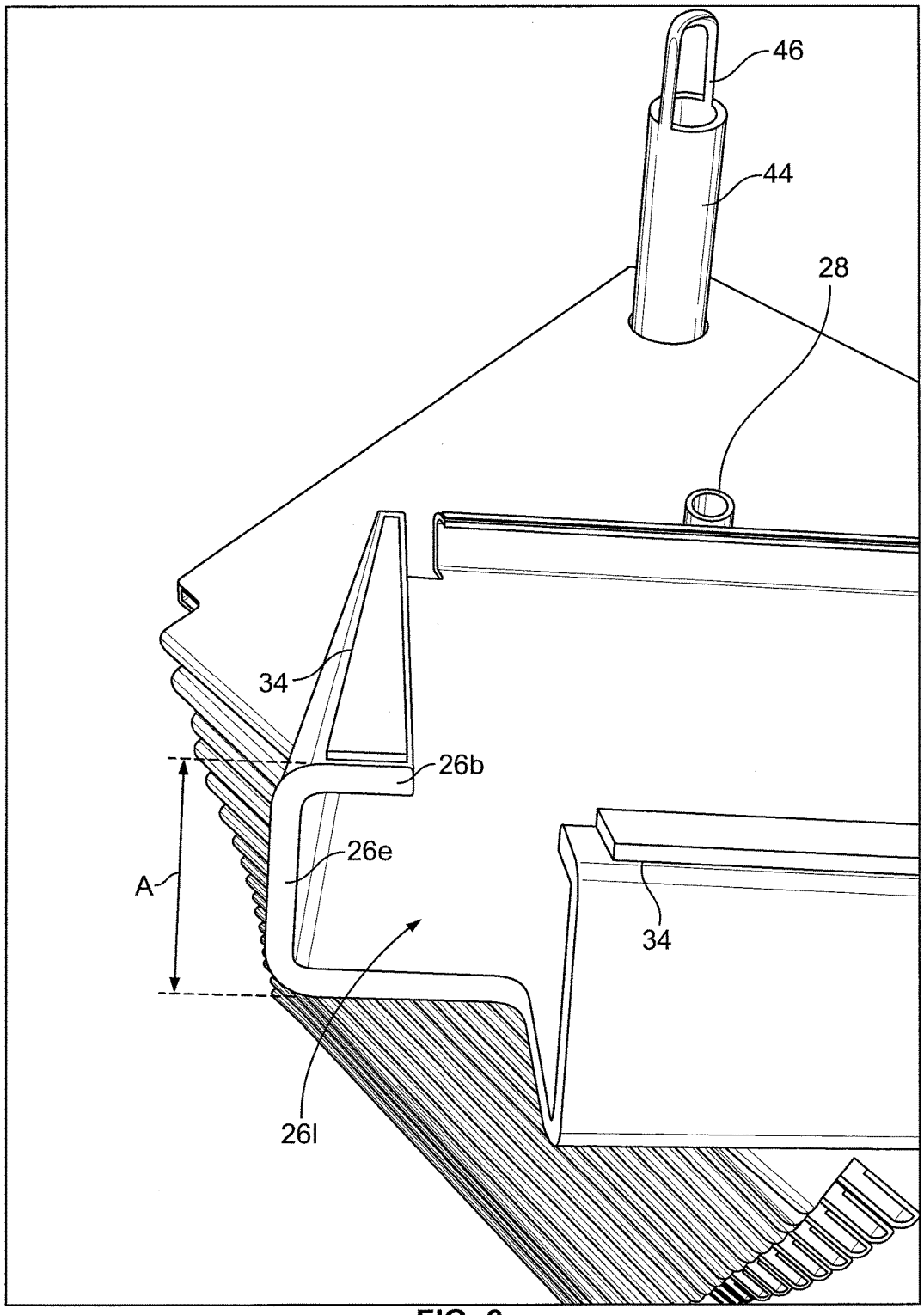
FIG. 6 is a perspective view of the bottom of one embodiment of a stand used in the present invention.

In FIGS. 5 and 6, the illustrative embodiment of a stand base 26 is shown, in a generally turned over position, so as to reveal the underside 36 of a preferred embodiment of stand base 26. In the illustrative embodiment, stand base 26 is formed from a generally rectangular sheet of steel, although other materials can be substituted by persons having ordinary skill in the art without departing from the teachings of the present invention. In the illustrative embodiment, the rectangular base sheet is preferably a square sheet, which is punched and/or cut to form a shape that allows for the bending of each lateral side at least two times, to form an elevated side 26*e* and a bottom surface 26*b* at each end of the square sheet; providing a height element "A" to base stand 26 and a surface to rest on a floor or roof. Persons having ordinary skill in the art will understand the size, shape, thickness and cuts that are necessary to produce a sheet of steel, bend the steel and prepare it for use in the present invention, such that only a minimal explanation of the process is provided herein. In addition, it will be understood that the dimension of base 26 and the lateral openings 261, shown in various figures, can be configures such that a typical fork lift device can be used to life one or more stand base 26.

As is shown in the figures, in one embodiment stand base 26 comprises at least one drain hole 29, one or more pillar receiving openings 30, a stacking hole 32, and non-slip elements 34, such as a section of roughened steel or a strip of material having a higher co-efficient of friction than the base stand 26 material, or other non-slip products as known to persons having ordinary skill in the art, positioned as shown in FIGS. 5 and 6. Persons having ordinary skill in the art will recognize that the elements included in the drawing figures are a preferred embodiment of the invention and that any one or more of the elements may be removed without departing from the novel scope thereof.

Figure 7:
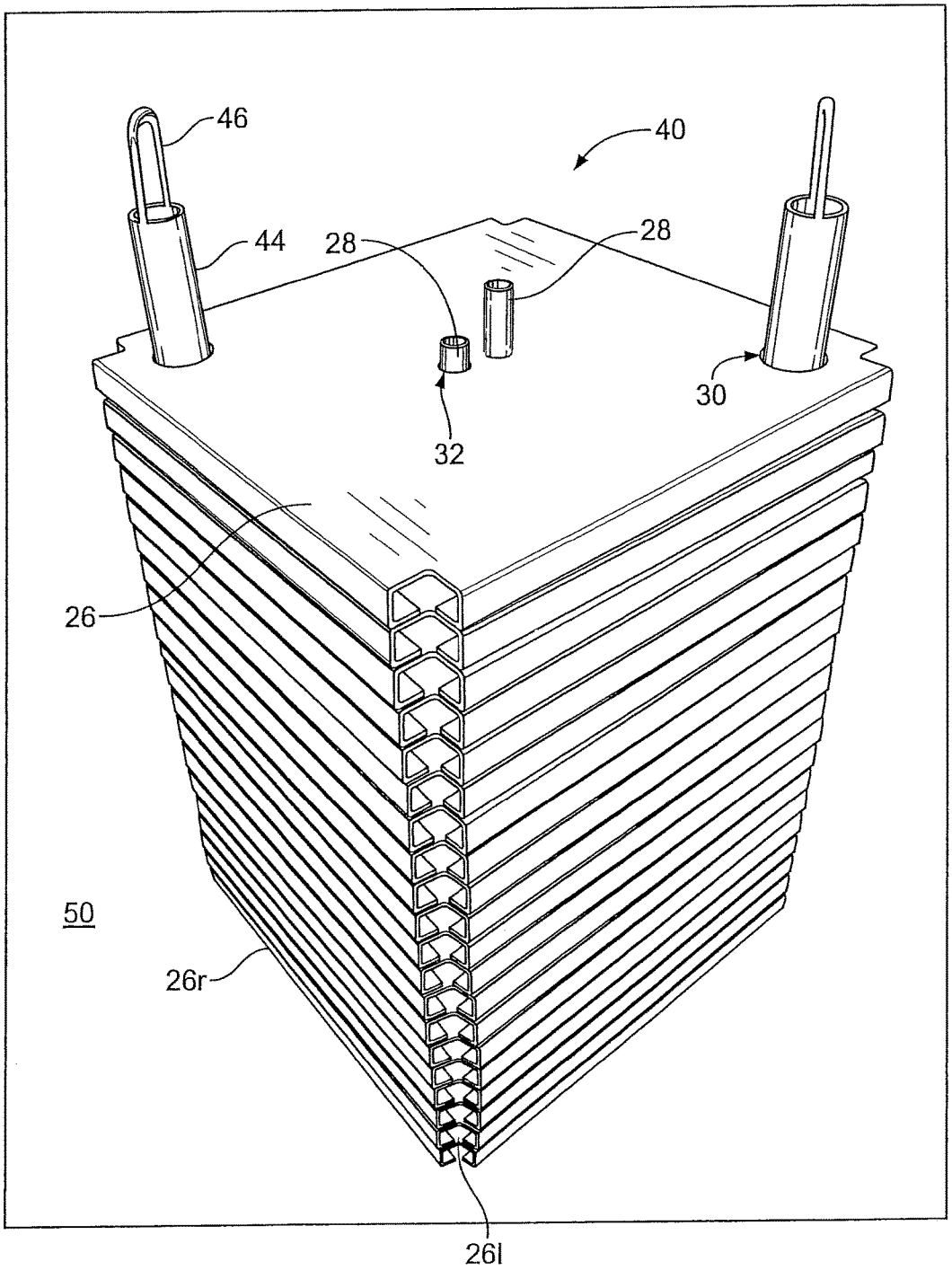
FIG. 7 is a perspective view of stands of the present invention in storage configuration, on a storage device of the present invention, showing elements used to store and transport the present invention.
Figure 9:
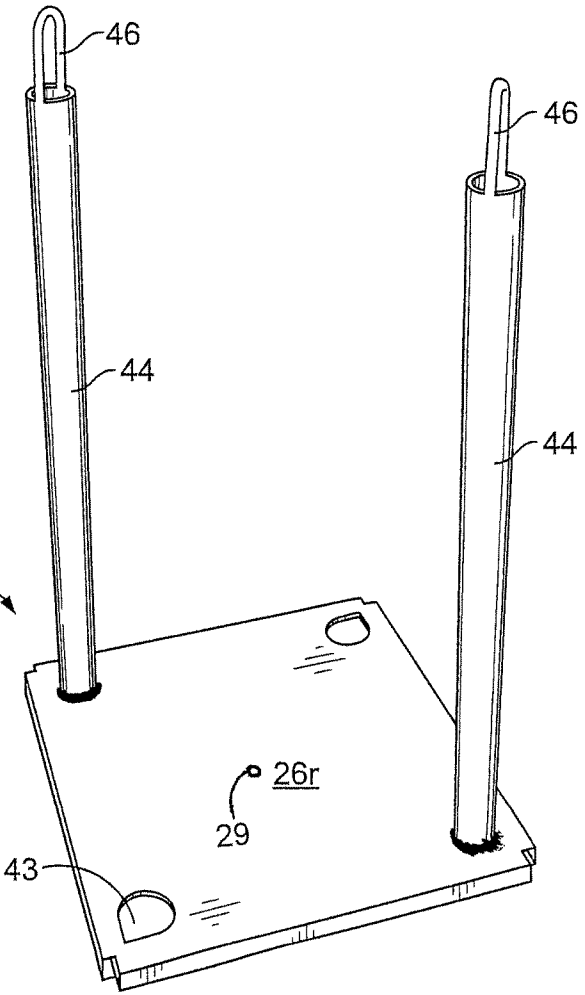
FIG. 9 is a perspective view of a stand storage device of the present invention
Figure 8:
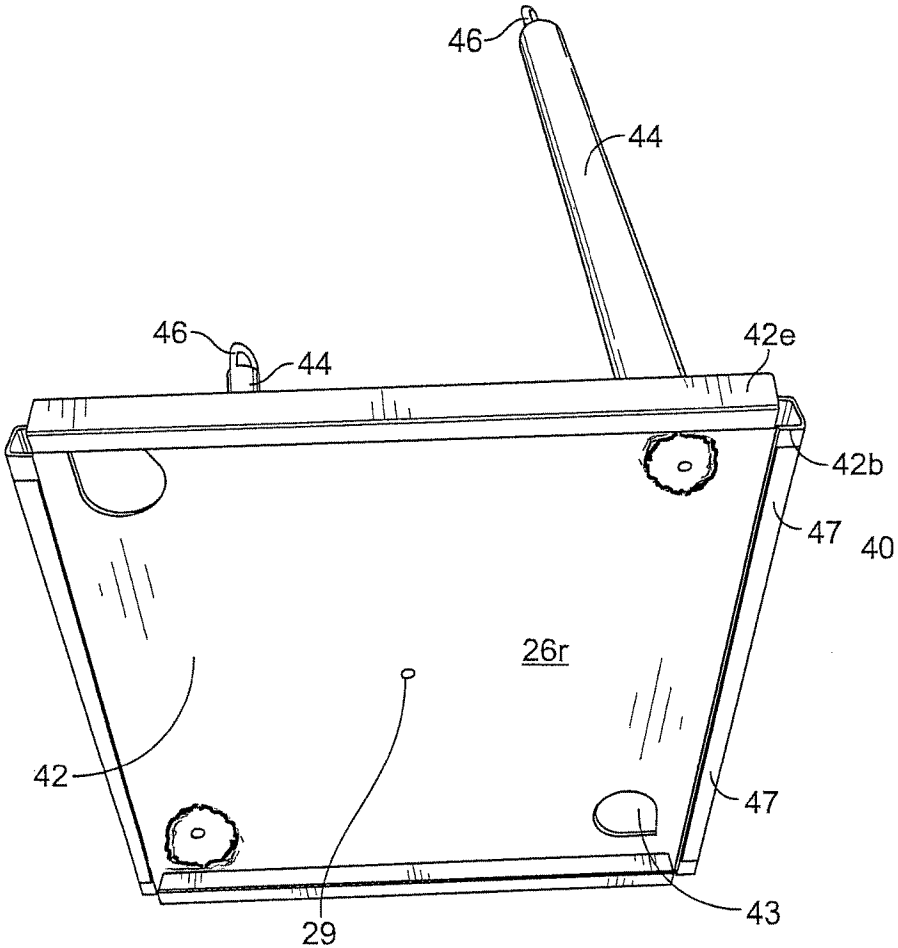
FIG. 8 is perspective view of the bottom of a stand storage device of the present invention.

Referring now to FIGS. 7, 8 and 9, elements of the inventive method of storing and storing for transport of the invention are shown. Shown in FIG. 7, is a ready for storage or movement collection of stand bases 26 positioned on a rack 40. FIGS. 8 and 9 more clearly show one embodiment of rack 40, illustrated without the placement of stand bases 26 thereon for clarity. In a preferred form, rack 40 comprises a base 26*r*, configured very much like a stand base 26 with some differentiating elements as will be discussed herein. Attached to base 26*r* are one or more rack pillars 44 having eyelets 46 at the end distal to base 26*r*; pillars 44 are positioned adjacent opposing corners of base 26*r*, as shown in the figures. It will be seen, upon a comparison of the stand base 26 to the base 26*r*, best shown in FIG. 2, that pillars 44 are placed so as to coincide with pillar receiving openings 30 in a stand base 26. It will be understood that rack pillars 44 can be secured to base 26*r* by, among other ways known to persons having ordinary skill in the art, welding, attachment through cooperative threading and others. It will also be understood that while two rack pillars are shown, substantial stability could be achieved with a single rack pillar and the use of such a system is contemplated as part of the scope of the present invention.

As best shown in FIG. 8, the underside elements 42 of rack 40 can comprise correspondingly similar elements to those shown with respect to stand base 26, specifically, elevation elements 42*e*, bottom surface elements 42*b* and one or more non-slip elements 47 positioned substantially as shown in FIG. 8. In addition, openings 43 can be provided to reduce the weight of rack 40, provide access to water drainage and for use in an anchoring system for rack 40. Persons having ordinary skill in the art will understand that rack 40 can also be made without any such openings 43 in situations where a more structurally significant stand base 26*r* is desired.

As can be seen in FIG. 7, pillar-receiving openings 30 can be threaded onto rack pillars 44 so as to hold the stand bases 26 in place on base 26*r*. Multiple stand bases 26 can be stored in a stackable configuration 50 as shown in FIG. 7. When stand bases 26 are stacked in position contiguous to pillars 44 of rack 40, it can be seen, most clearly in FIG. 7, that stanchion insert piece 28 also fits into and is received by surface opening 32 to provide the stable and secure stackable position for the bases 26 noted above. Referring again to FIG. 4, there is further illustrated the above-described connection of the bases 26 when they are in a stacked position. As with stanchions 18, it will be understood that the use of rack pillars 44 having a circular cross section, as shown in the figures, is for illustrative purposes and that a pillar, or column, having any cross sectional shape can be used instead, without departing from the novel scope of the present invention.

As shown in FIG. 7, during storage and transportation of the invention, multiple stand bases 26 can be stacked into position on rack 40. Eyelets 46, on rack pillars 44, extend above the last stacked base 26 of stacked base configuration 50. The hooks from a crane or other lifting apparatus, can then be securely attached to eyelets 46 and used to lift the entire stacked base configuration 50 to the top of a structure's roof or other elevated work surface. It will be understood that eyelets 46 can be created by welding processes, by threading segment together, by molding and by other methods know to persons having ordinary skill in the art and providing the structural abilities required by the element and the combinations of elements described herein. When stacked base configuration 50 is in place on a structure's roof or other surface, the lift's hooks can be removed from eyelets 46 and bases 26 can be quickly and easily removed from rack 40. Tools are generally not required for assembly of the flag warning line system. It will be seen, as described above, that a fork lift can be used to lift off one or more stand bases 26 from the base configuration 50 and help to place them as needed on a roof or other surface.

Figure 10:
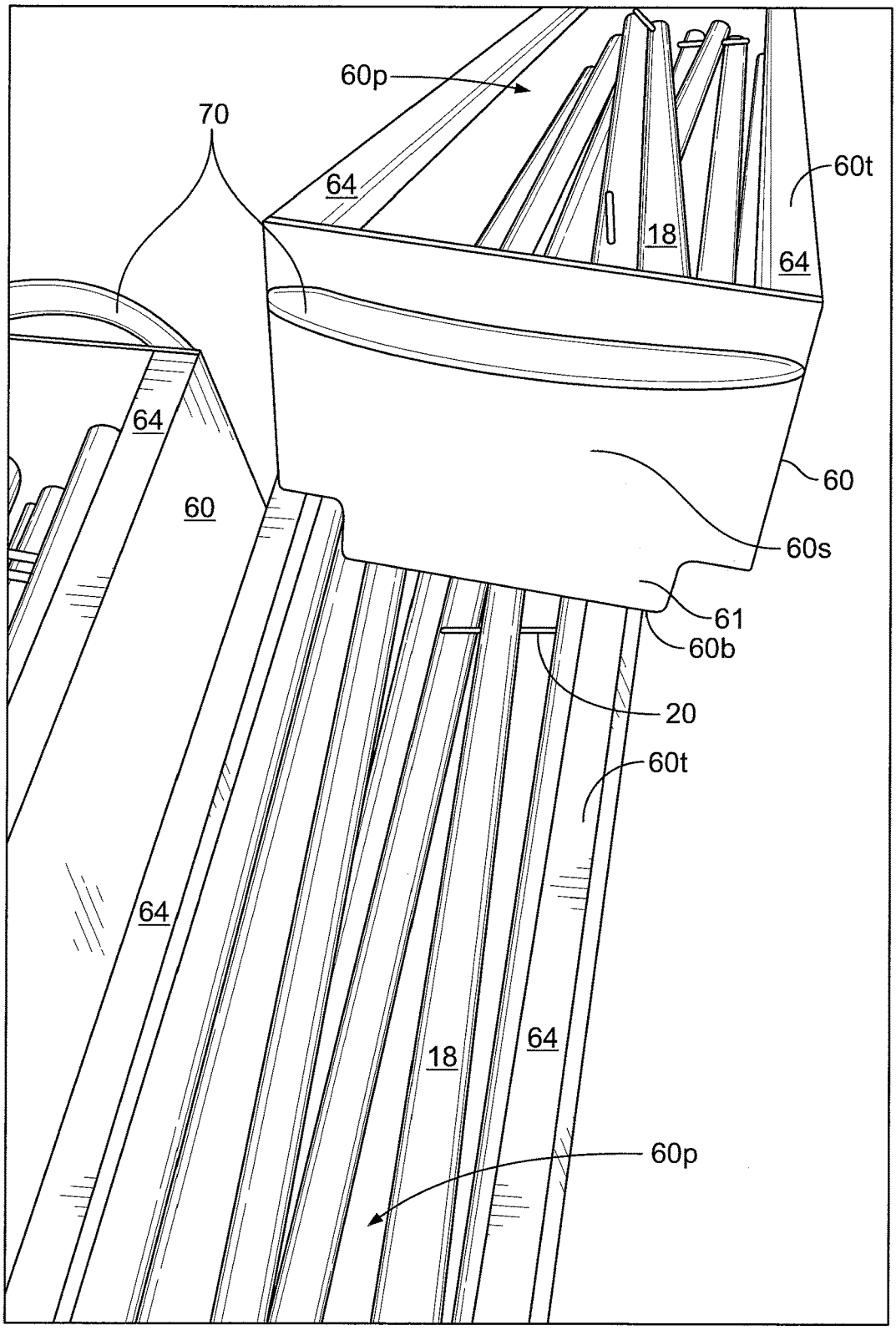
FIG. 10 is a perspective view of a stanchion storage device of the present invention with stanchions stored therein.
Figure 11:
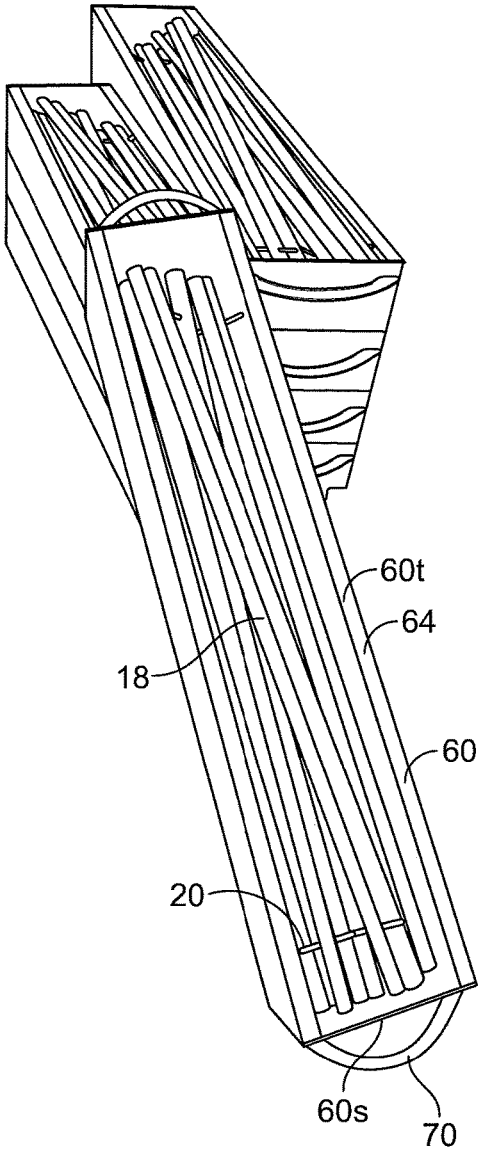
FIG. 11 is a perspective view of several stanchion storage devices, with stanchions stored therein, showing the stackability of the stanchion storage devices.
Figure 12:
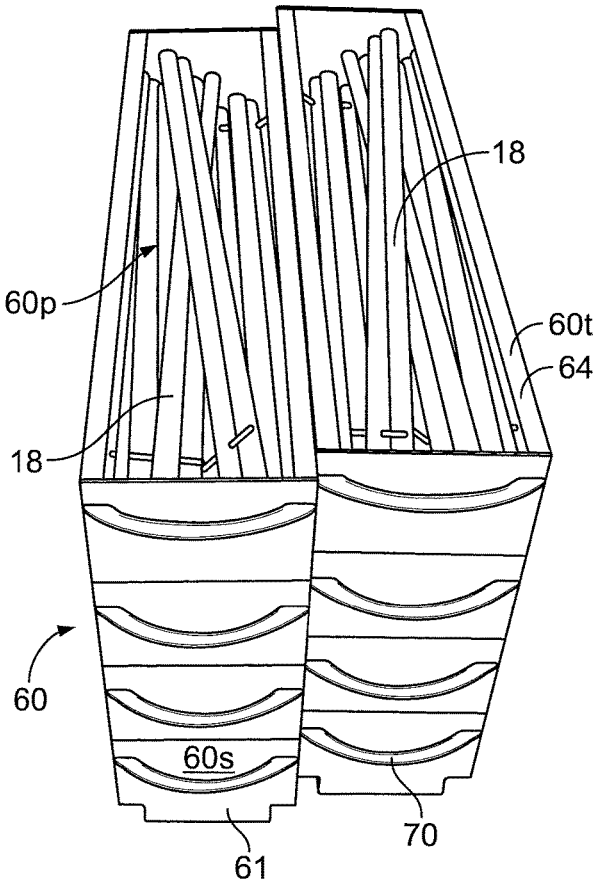
FIG. 12 is another perspective view of stacked stanchion storage devices.

In addition to making the stand bases 26 easy to store or transport, the present invention also provides a means to store and transport the stanchions 18 of the present invention. As shown in FIGS. 10, 11 and 12, in a preferred embodiment of the present invention, there are provided one or more stanchion storage cases 60, the number of such depending on need. In the illustrative embodiment storage case 60 is shown generally as a rectangular cuboid. As a rectangular cuboid, any number of cases 60 can be filled with stanchions 18 and stacked together for easy storage and transportation. Cases 60 can be constructed so as to provide a generally flattened rim or top edge 64 along the length of the top 60*t* of case 60. With such an edge 64, the stability of one case 60 placed on top of another is improved.

In another embodiment, illustrated in the figures, it will be seen that case 60 can be constructed so as to have a section of diminished width 61 (and therefore, concomitantly, diminished volume) along the bottom of case 60 relative to the shorter ends 60*s* of the rectangular cross section of case 60. The diminished width (and volume) thereby providing, on each of the shorter ends 60*s* of case 60, a cut-out section that extends the entire length of case 60, and defines a smaller volume section therein. The area of the bottom of the smaller volume section, in a preferred embodiment, is constructed so as to fit within the inner perimeter of the opening 60*p* of the case 60, so that one case 60 can be nestled into the top opening 60*p* of another case 60; further enhancing stability in stacking such cases 60 and for compactness. It will be understood by persons having ordinary skill in the art, that the diminished volume section of case 60 can be constructed such that the volume is contiguous with the volume of the case (so as to provide more volume for storage) or can be constructed incontiguously with the volume of case 60, so as to merely assume a useful stabilizing shape for nestling into opening 60*p*. In the latter instance, stability can be more inexpensively achieved by adding flanges along and parallel to the length of the bottom of case 60, at or near where the diminished width 61 was shown to have been created above. Storage cases 60 can include handles 70, at opposite ends of case 60 as shown in the figures, for ease of carrying. Multiple stanchions 18 may be placed within each storage case 60, and then the cases can be stacked together, for easy storage and transportation of stanchions 18.

As disclosed, in various embodiments, the elements of the perimeter warning system with storage and transport devices of the present invention can be made form a variety of material such as metals, including composites, plastics and wood depending on the particular application required. Combinations of these materials can be used in one system without departing from the novel scope of the present invention. In one embodiment, the stands and/or stanchions are dipped in hot galvanized compound to minimize corrosion. In one embodiment, each stand weighs approximately 45 lbs to 55 lbs. For other applications, additional or less weight can be used for the stands as required, without departing from the novel scope of the present invention. In some applications of the invention, welding of parts is the method of construction, in others parts can be threaded together as previously described and such technics as forming through metal work, molding, injection molding and 3D printing can be used to create the parts of the present invention.

As shown in FIG. 1, during use of the invention, multiple stand bases 26 are spaced apart adjacent the perimeter of a structure's roof edge. Stanchions 18 are removed from storage cases 60 and then securely inserted into pole insert points 28 until the required number of stands 26 with stanchions 18 are in position to form the necessary (or required) flag line dimensions to secure the work area. As best shown in FIGS. 1 and 2, flag line 14 is secured to a stanchion 18 at extension pieces 20, forming a line tie off point 16. This process of securing the line to each stanchion 18 and extension piece 20 continues until all of the stanchions 18 are joined, by one or more flag lines 14, to complete a perimeter warning system.

In summary, some, but not all, of the differences and benefits of the current and various embodiments of the invention as illustrated in FIGS. 1 to 12 are summarized below:

1. A storage rack holds the stands firmly in place when not in use.
2. The rack also provides the ability to securely hoist the stands to the roof.
3. A non-skid surface on the bottom of the stand and storage rack is provided for enhanced safety during use.
4. The stanchions used to hold flags and line, when in a vertical position during use fit inside the base of the stand giving the stand assembly enhanced stability.
5. Multiple elements of the stand design provide a stable way of stacking the stands while storing/transporting/loading them.
6. Stackable storage and transport devices for the flag stanchions may be provided in one form of the invention.

Specific embodiments of novel methods and apparatus for construction of flag warning line systems according to the present invention have been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention any and all modifications, variations, or equivalents that fall within the true spirit and scope of the basic underlying principles disclosed and claimed herein.

What is claimed is:

1. A perimeter warning system for use to warn persons, in construction and repair situations, of the proximity of an edge of a surface on which the person is present and from which he could fall, comprising:

a flag line;

a plurality of stanchions;

a plurality of stand bases at least equal in number to the plurality of stanchions, each stand base having a stanchion insertion point, comprising a sleeve into which the stanchion is berthed, to hold at least one stanchion in a generally upright position when assembled together, and each stand base having means to be secured, including a generally solid flat surface having at least one dedicated opening therein on each stand base, to a base which has means, including at least one pillar, sized to fit within the at least one dedicated opening of each stand base, to secure the stand bases thereto when the stand bases are not in use and stacked thereon and on each other;

each stand base being capable of placement near the edge of a surface across which edge there is danger;

wherein the plurality of stand bases and plurality of stanchions are assembled together to form a means to hold the flag line so as to create a visible line of flags to warn of the proximity of the edge of the surface, when warning is needed;

wherein each stand bases comprises a surface which defines an opening into which the stanchion insertion point of another of the plurality of stand bases can be inserted when the stand base and the another stand base are stacked together and at least one other opening;

wherein the plurality of stand bases are stored together, and when so stored securely transportable generally and between a ground position and an elevated position, by stacking them on the base by the stanchion insertion point and the means to be secured of the stand bases, when not in use or when being transported; and, wherein the base of the perimeter warning system comprises a storage and transportation element, the storage and transportation element comprising a surface onto which the plurality of stand bases can be stacked, one atop another, for storage and transportation.

2. The perimeter warning system of claim 1, wherein the plurality of stand bases are capable of being placed together on the base for storage and transportation.

3. The perimeter warning system of claim 1, wherein the stanchion insertion point of each stand base and the opening defined in the surface of each stand base is, on each stand base, symmetrically equidistant from the center point of the surface of that stand base.

4. The perimeter warning system of claim 1, wherein the at least one other opening allows for any water thereon to drain off of the surface of the stand base.

5. The perimeter warning system of claim 1, wherein the storage and transportation element comprises the at least one pillar extending, generally perpendicularly, from the surface of the storage and transportation element.

6. The perimeter warning system of claim 5, wherein the at least one other dedicated opening defined in the surface of each of the plurality of stand bases is defined so as to allow the at least one pillar to be threaded therethrough.

7. The perimeter warning system of claim 1, including at least one storage case for holding the plurality of stanchions for storage and transportation when the warning system is not in use.

8. The perimeter warning system of claim 7, wherein the at least one storage case is two storage cases having means to allow one to be stacked on the other.

9. The perimeter warning system of claim 1, wherein the at least one pillar comprises a top having connection means onto which external equipment, which can lift and place the entire system to a desired location, can be connected.

10. The perimeter warning system of claim 9, wherein the connection means is an eyelet and the external equipment is a device for attachment to the eyelet.

11. The perimeter warning system of claim 9, wherein the at least one pillar is at least two pillars.

12. A method of storing and transporting a perimeter warning system, for use to warn persons, in construction and repair situations, of the proximity of an edge of a surface on which the person is present and from which he could fall, including the steps of:

providing the perimeter warning system of claim 1;

providing a means to lift the base, either alone or with one or more stand bases stacked thereon; and, lifting a base to a position at or near a desired warning location such that when the base has one or more stand bases thereon the entire perimeter warning system can be transported to the warning location for deployment and when desired the system can be moved to storage or a new location.

13. The method of storing and transporting a perimeter warning system of claim 12, wherein the at least one pillar comprises a top having connection means onto which external equipment, which can lift and place the entire system to a desired location, can be connected.

14. The method of storing and transporting a perimeter warning system of claim 13, wherein the connection means is an eyelet.

15. The method of storing and transporting a perimeter warning system of claim 12, wherein the at least one pillar is at least two pillars.

* * * * *